US005743028A

United States Patent [19]

Lombardino

[11] Patent Number: 5,743,028

[45] Date of Patent: Apr. 28, 1998

[54] SPRING-AIR SHOCK ABSORBTION AND ENERGY RETURN DEVICE FOR SHOES

[76] Inventor: Thomas D. Lombardino, 82-11 160th. Ave., Howard Beach, N.Y. 11414

[21] Appl. No.: 727,705

[22] Filed: Oct. 3, 1996

[51] Int. Cl.[6] ..... A43B 21/30; A43B 21/32

[52] U.S. Cl. ..... 36/27; 36/28; 36/38

[58] Field of Search ..... 36/27, 28, 35 R, 36/37, 38, 34 A

[56] References Cited

U.S. PATENT DOCUMENTS

| | | | |
|---|---|---|---|
| 487,779 | 7/1892 | Marinitsch | 36/28 |
| 968,020 | 8/1910 | Yandoli | 36/27 |
| 1,502,087 | 7/1924 | Bunns | 36/28 |
| 3,665,621 | 5/1972 | Massella | 36/37 |
| 4,492,046 | 1/1985 | Kosova | 36/27 |
| 4,815,221 | 3/1989 | Diaz | 36/38 |
| 4,843,737 | 7/1989 | Vorderer | 36/27 |
| 5,060,401 | 10/1991 | Whatley | 36/27 |
| 5,224,278 | 7/1993 | Jeon | 36/27 |
| 5,282,325 | 2/1994 | Deyl | 36/27 |
| 5,381,608 | 1/1995 | Claveria | 36/27 |
| 5,544,431 | 8/1996 | Dixon | 36/27 |

FOREIGN PATENT DOCUMENTS

| | | | |
|---|---|---|---|
| 666436 | 8/1964 | Italy | 36/38 |

*Primary Examiner*—Paul T. Sewell
*Assistant Examiner*—Anthony Stashick

[57] ABSTRACT

A shoe heel insert, especially suitable for athletic shoe applications, providing for superior shock absorption and energy return characteristics to the wearer, as well as a high degree of stability. The unit which is referred to as the SPRING-AIR SYSTEM, will consist of a substantially heel shaped outer spring mechanism which also serves as the internal spring housing by way of a plurality of internally formed projections, and a plurality of vertically affixed compression springs retained by the said projections with the springs biasing the outer spring mechanism. The entire unit will be filled with a pressurized gas and hermetically sealed with a clear, durable polyurethane material which completely encapsulates the device while still allowing the inner springs to be visible. The assembled unit will be molded within the heel section of the mid-sole of an athletic shoe, or any suitable type shoe, during the shoes manufacturing process. The internal spring members will be disposed directly below the calcaneus of the wearer and the transparent nature of the devices encapsulation will allow the rear part of the shoes sole to be molded in such a way that the system can be partially exposed, adding further novelty to the shoe.

3 Claims, 3 Drawing Sheets

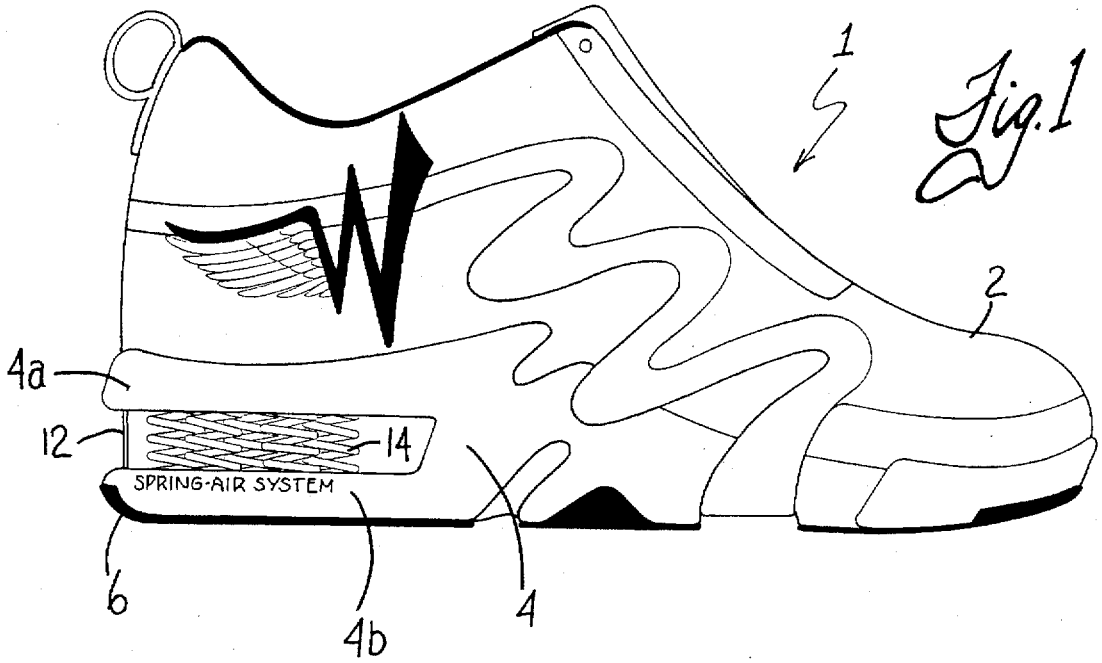
Fig. 1
Fig. 2
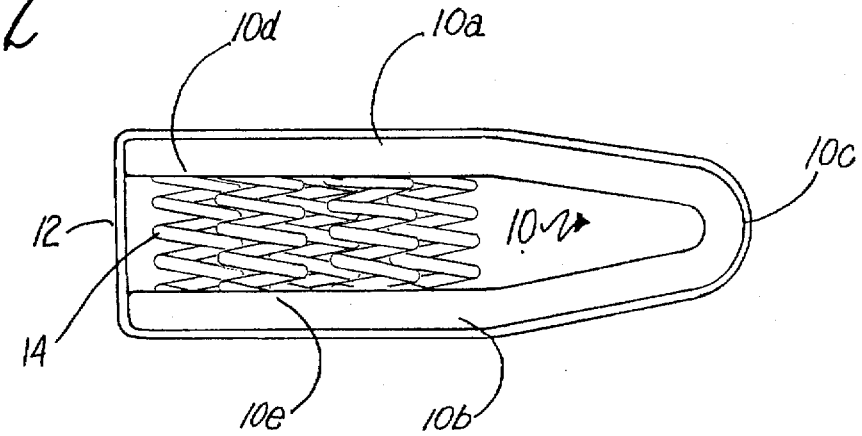

SPRING-AIR SHOCK ABSORBTION AND ENERGY RETURN DEVICE FOR SHOES

BACKGROUND OF THE INVENTION

1. Field of the Invention

The invention relates to improved athletic footwear, and particularly, improvements of superior shock absorbing, energy storing and energy return characteristics by way of a hermetically sealed gas-filled heel insert comprising the use of a spring mechanism and a plurality of compression springs.

2. Description of the Prior Art

Today's professional and non-professional athletes alike are continually striving to improve their performance levels, while at the same time, reduce injuries. This can be achieved to some degree by the use of improved sporting equipment, and more specifically improved athletic shoes. The invention disclosed herein is a substantial improvement on any of the prior art that incorporates spring devices in the heel section of the sole of athletic shoe and therefor, will be of further benefit to the user in terms of an even higher degree of performance enhancement and injury reduction.

When playing sport, specifically in high impact sports such as volleyball and basketball, and in running activities in general, the athletes foot, specifically in the area of the calcaneus, the heel bone, is prone to extreme stress due to the thousands of pounds of force that will be applied upon heel strike during the course of a single sporting activity. Further, when an athlete comes down improperly on the heel of his foot, such as on the side of the heel, or if they land on another players foot which is especially common in basketball, in most types of athletic shoes the force cannot be displaced and therefor the wearers foot is forced to twist causing many ankle injuries each year. Still further, when an athlete inadvertently lands with a majority of their weight on the heel of the foot, instead of the fore or mid foot, severe lower back injuries can be incurred from this shock. It is therefor desirable to have a shoe which can effectively reduce the amount of shock received through the heel and also more effectively displace the impact throughout the heel area while still maintaining sufficient stability of the shoe sole to provide for quick lateral movement of the athlete in the shoe.

While shock reduction characteristics are essential to a good athletic shoe, performance improvement features are just as desirable to an athlete. The performance enhancement can be achieved by storing the shock energy imparted by foot strike and return a substantial amount of the energy to the wearers foot during the propelling-off portion of the stride.

As mentioned, prior art has disclosed spring-devices in the heel of athletic shoes for the purposes of absorbing shock and returning energy to the wearers foot. For example, U.S. Pat. No. 4,815,221, Diaz discloses an energy control system comprising a spring plate having a plurality of spring projections depending from and distributed over the surface of the plate which is disposed within a cavity formed within the mid-sole of an athletic shoe.

In U.S. Pat. No. 5,381,608 Claveria discloses a composite heel plate with a vertically acting spring member appending from it encapsulated within the heel section of the sole of an athletic shoe.

In U.S. Pat. No. 5,437,110 Goldston et al. shows an adjustable heel spring and stabilizer device to provide various degrees of shock absorption and energy return characteristics by way of a user adjustable fulcrum movably positioned within a spring mechanism which is disposed within the mid-sole of the athletic shoe.

Finally, in U.S. Pat. No. 5,511,324, Smith shows a single compression spring vertically affixed through the heel section of the sole of an athletic shoe.

SUMMARY OF THE INVENTION

A principal objective of the present invention is to provide a substantial improvement in the shock absorbing abilities of an athletic shoe over previous related inventions.

A second objective is to provide a substantial improvement in the energy storing and return abilities of an athletic shoe over previous related inventions.

Another objective is to provide a sufficient amount of lateral stability to the shoe in conjunction with its shock absorbing and energy return characteristics.

It is a further objective to provide a device which can be exposed within the mid-sole of an athletic shoe, and not concealed within it, making it integral to the design novelty of the athletic shoe for which it is placed in.

It is yet another objective to provide an invention which is easy and cost effective to manufacture of common materials, is easily inserted into the mid-sole of an athletic shoe as a singular assembled component, and durable to withstand an average usage lifetime similar to other high quality athletic shoes currently available on the market.

It is a final objective to be able to easily and cost effectively tune the elements of the current invention at the time of manufacture as to allow the shock absorbing and energy return dynamics of the device to be adjusted according to its intended use, such as basketball, tennis, running, etc., and to be suitable for use by various users of different weights and shoe sizes.

These and other objectives are realized by providing an athletic shoe heel insert consisting of a substantially heel shaped outer spring mechanism made of a glass or carbon filled thermoplastic. The outer spring mechanism also serves as an internal spring housing having a plurality of internally formed projections. The said projections will engage with the interior diameters of a plurality of stainless steel or similar type compression springs which are disposed in and biasing the outer spring mechanism. The outer spring mechanism will be encapsulated with a transparent hermetically sealed air impermeable polyurethane type material which will retain a given amount of a pressurized gas which is inserted into the internal chamber of the encapsulated device. The assembled unit is fixedly disposed within the mid-sole of an athletic shoe upon the manufacture of the mid-sole.

BRIEF DESCRIPTIONS OF THE DRAWINGS

FIG. 1 is a side view of a right foot athletic shoe within which the device of the present invention is shown incorporated into the heel section of the mid-sole;

FIG. 2 is a side view of the device of the present invention;

DETAILED DESCRIPTION OF THE PREFERRED EMBODIMENT

Figure 3:
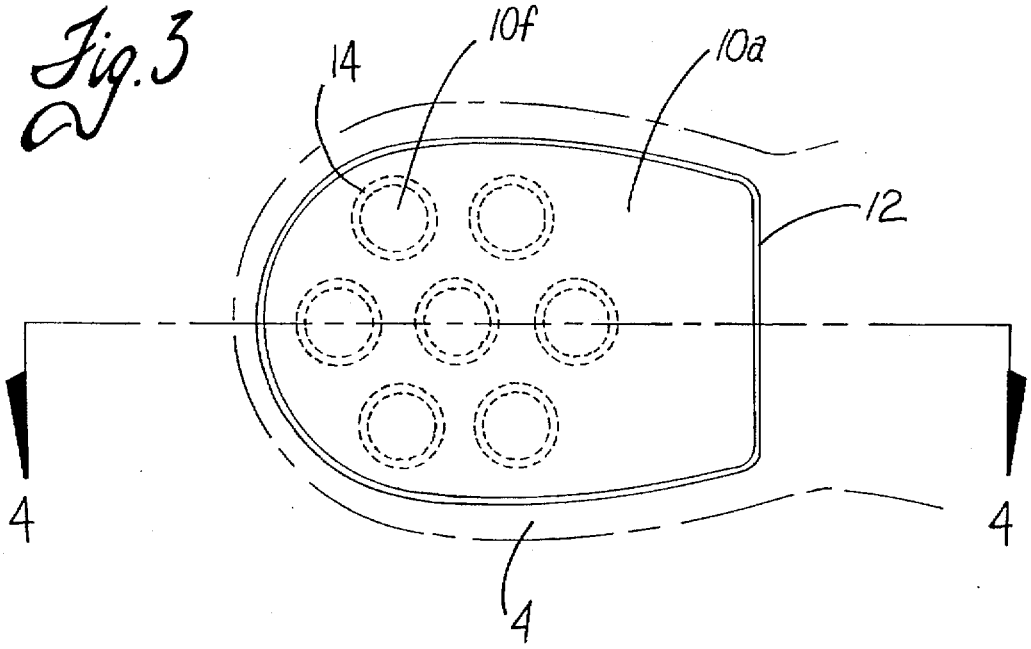
FIG. 3 is a top view of the device of the present invention.

FIG. 1 shows the right foot of an athletic shoe 1 that consists of an upper 2, preferably made of leather, which is attached to a mid-sole 4 made of a resilient foamed polyurethane type material, and an out-sole 6 made of a more durable unfoamed type of polyurethane or another type of hard rubber attached to the bottom portion of the mid-sole 4. Between the upper heel portion 4*a* and the lower heel portion 4*b*, is shown the vertically affixed compression springs 14 and the transparent polyurethane encapsulating material 12 of the present invention which will be fully discussed in detail below.

FIG. 2 and 3 show the preferred embodiment of the present invention which includes a substantially heel shaped outer spring mechanism and internal spring housing 10, constructed of a molded glass or carbon filled thermoplastic, or possibly of stainless steel, which comprises a top plate 10*a* and a bottom plate 10*b* which run horizontally and parallel to each other with the top plate 10*a* being cantilevered over the bottom plate 10*b* by way an integrally molded connecting member 10*c* at the forward portion of the said outer spring mechanism and housing 10. Running around the perimeter of the upper plate 10*a* is a downwardly flanged lateral support edge 10*d* that begins at a point slightly set back from the connecting member 10*c* and stops at the adjacent side of the said upper plate 10*a*. On the lower plate 10*b*, and corresponding to the placement of the upper lateral support edges 10*d*, is an upwardly flanged lateral support edge 10*e*. The support edges 10*d*, 10*e* are designed primarily to provide lateral stability and to prevent heel torque of the athletic shoe 1.

Further illustrated are seven stainless steel or similar type material compression springs 14 which are vertically affixed within, and biasing the upper plate 10*a* and lower plate 10*b* of the outer spring mechanism and internal spring housing 10. The springs 14 are held in place by way of integrally molded spring retaining projections 10*f*. Finally, the entire device is encapsulated within a transparent polyurethane material 12 of a thickness of approximately 1/32" that is hermetically sealed and will retain a given amount of a pressurized gas such as Argon (Ar) or Krypton (Kr). The internal gas pressure, when combined with the spring action of the spring mechanism and the internal compression springs 14, will further serve to provide for the superior shock absorbing, energy storing and energy return characteristics of the device within the shoe. The use of inert gases such as Argon, or more preferably Krypton, are designed to prevent no diffusion of ambient air outside the polyurethane encapsulement 12 from entering into it, and more importantly, due to its heavier weight than the outside ambient air at atmospheric pressure, allows for a much slower rate of diffusion of the internal gas thru the polyurethane encapsulement 12. This will allow for stable air pressures during the useful lifetime of the shoe 1. It should be noted however that the internal air pressure of the device is not a primary source of the shoes shock absorbing or energy return features, and the shoe can still function satisfactorily even if a large amount of air was to diffuse out. The internal air pressure serves mostly to provide lateral shock absorbtion upon ground contact, to reinforce the device against bottoming out and to stabilize the sides of the polyurethane material 12 that encapsulates the device, said polyurethane material 12 serving as the attaching member of the said device within the heel of the mid-sole 4.

The device of the present invention as illustrated thus far is to be engineered in several different configurations. Specifications that can be changed are the size and tensioning of the heel shaped outer spring mechanism and internal spring housing 10, the height, diameter and load rates of the compression springs 14, and the amount of gas pressure within the device ranging from about 5–25 psi. These variables in design will allow the shoes which the device is incorporated into to be specifically suited, or tuned, for that activity. For example, in a shoe that will be used for jogging it would be desirable to have a shoe with a high degree of shock absorbing qualities and average energy return characteristics. A running shoe would require less shock absorbing abilities and a more direct return of energy to the wearer. In a sport such as basketball or tennis, optimum energy storing and return characteristics for jumping and quick changes in direction are necessary while also being capable of giving the wearer a fair amount of shock absorbtion. Also required is a high degree of lateral stability within the shoe since these sports require significant lateral movements. This type of shoe would require the firmest configuration of spring members and air pressures in order to be suitable. Finally, a shoe used for crosstraining, which essentially means it can be used for various types of activities, would have a configuration probably somewhere between that of the running shoe and that of the basketball shoe.

Another factor which will determine the tuning characteristics is the weight of the wearer. Since body weight can vary greatly in relation to shoe sizes, the device will have to be engineered to handle the average range of weight within each perspective shoe size and for the activity in which it is intended. It is therefore of my opinion that having several individually engineered devices will allow for a suitable matchup of the device and the shoe that it will be used in, based on the above mentioned requirements and variables of which the shoe is to be used in, providing for satisfactorily performance in almost all applications.

Figure 4:
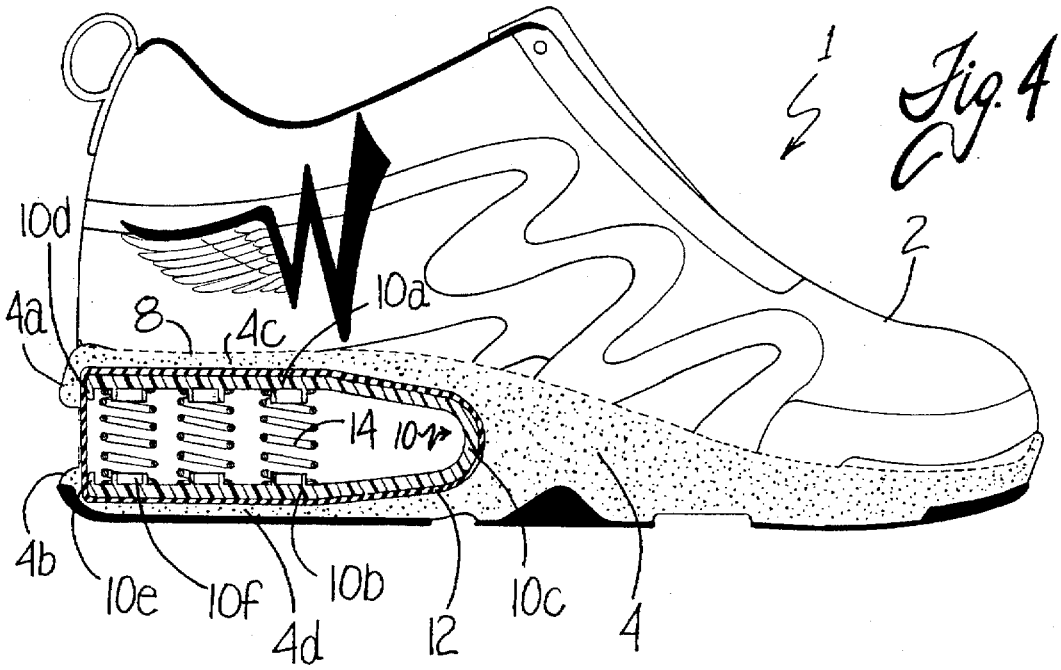
FIG. 4 is a another side view of the shoe of FIG. 1 showing a cutaway of the device of the present invention incorporated into the mid-sole of the shoe as taken along line 4 of FIG. 3.

Referring now to FIG. 4, a cutaway of the mid-sole 4 portion of the shoe 1 taken along line 4 of FIG. 3 is shown disclosing the device of the present invention within the upper heel portion of the mid-sole 4*c* and the lower heel portion of the mid-sole 4*d*. As seen here, the transparent polyurethane material 12 encapsulates the outer spring mechanism and inner spring housing 10, and is fixably attached to the aforementioned parts of the mid-sole 4, 4*c*, 4*d* by way of an adhesive such as cyanoacrylate. The internal portion of the polyurethane material 12 that is in contact with the outer spring mechanism 10 will also be fixably attached in a similar manner as to prevent the said material from pulling away from the outer spring mechanism 10 during heel strike of the shoe and deflection of the said outer spring mechanism 10.

As previously described in FIG. 2, FIG. 4 also discloses the top plate 10*a* and the bottom plate 10*b* of the outer spring mechanism and internal spring housing 10. The internal portions of the top plate 10*a* includes seven top spring retaining projections 10*f* and the bottom plate has seven corresponding retaining projections 10*f* which fit into the interior diameter of the vertically affixed compression springs 14 that are biasing against the interior portions of the outer spring housing 10. At the rear of the device is shown a cutaway view of the downwardly flanged lateral support edge 10*d* of the upper plate 10*a* and the upwardly flanged lateral support edge 10*e* of the lower plate 10*b*. As previously described, the said lateral support edges 10*d*, 10*e* give the shoe lateral stability and also prevent heel torque. Secondary objectives of the support edges provide for a more substantial mating area for the side portions of the transparent polyurethane material 12 with the outer spring housings 10 edges. This also allows the external portions of the rear of the mid-sole 4*a*, 4*b* to firmly encompass the upper and lower portions of the outer spring mechanism 10. The placement of the device of the present invention will generally be centered in the area of the shoe 1 directly below the calcaneous, or heel bone, of the wearers foot.

Figure 5:
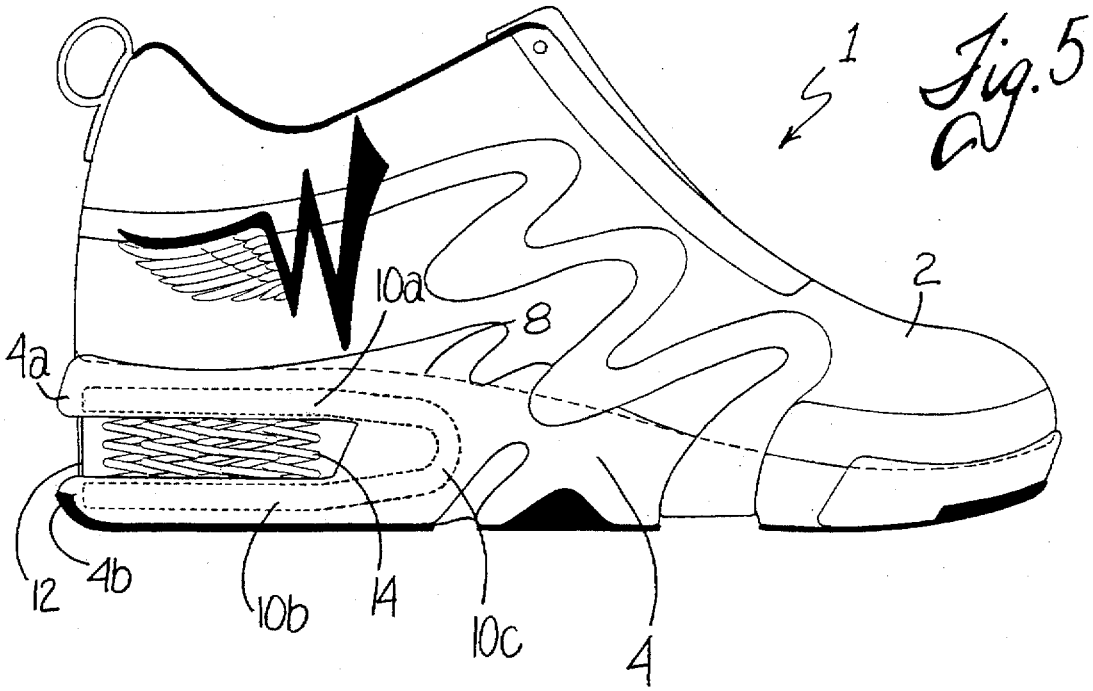
FIG. 5 is final side view of the shoe shown in FIG. 1 showing the relative position of the device of the present invention within the heel section of the mid-sole, being illustrated by phantom lines.

In FIG. 5, another view of the placement of the device of the present invention within the mid-sole 4 of an athletic shoe 1 is shown by the use of phantom lines. Also shown is the general proximity of the insole 8 area where the foot will situate, in relation to the position of the device. It can also be more clearly seen how the external upper portion of the heel of the mid-sole 4*a*, and the external lower portion of the heel of the mid-sole 4*b* encompass the upper and lower sections of the outer spring mechanism 10 fixedly disposed within.

From the foregoing discussion it is obvious that one skilled in the art could make modifications in the design and materials of the preferred embodiment as well as the method of manufacture without departing from the scope and spirit of the present invention. It is therefore intended that this patent only be limited by the scope of the following claims.

What is claimed is:

1. An article of footwear of the type which includes an upper, a resilient mid-sole attached to the upper, and an out-sole attached to the mid-sole with a spring mechanism visibly exposed within an upper and lower heel portion of the mid-sole that will provide for a substantially improved means of absorbing shock, and storing and returning energy during running and jumping activities, the improvements comprising;

a. a substantially heel shaped outer spring mechanism molded of a strong resiliently flexible material;

b. said outer spring mechanism having corresponding planar top and bottom plates running parallel to one another and generally horizontally to the mid-sole and being cantilevered from an integral connecting member at the forward end of the spring mechanism;

c. the outer spring mechanism further comprises lateral edges on the top plate that are flanged downwardly beginning at a point set back from the said connecting member that encompass the perimeter of and terminate at an adjacent end of the top plate;

d. lateral edges on the bottom plate that are flanged upwardly and correspond with the lateral edges on the aforementioned top plate;

e. a plurality of integrally molded projections, spaced in a corresponding circular pattern within the said top and bottom plates, and essentially disposed to reside in an area below the calcaneous of the wearer's foot when the spring mechanism is inserted within the heel portion of the mid-sole of an athletic shoe, f. the said plurality of integrally molded projections of the top and bottom plates serve to engage within an equal quantity of vertically affixed compression springs fixedly retained within, and biasing against the said outer spring mechanism, said springs working independently of one another thus providing a means for more effectively displacing shock throughout the outer spring mechanism, and;

g. said outer spring mechanism and all aforementioned elements comprising the outer spring mechanism being injection molded as a unitary component, providing for a simple and a cost effective means of manufacture.

2. The mechanism of claim 1 whereas;

a. the aforementioned outer spring mechanism encapsulated within a highly durable transparent polyurethane material providing relatively low air permeability characteristics and being about 1/32 of an inch in thickness;

b. said polyurethane material molded of two individual sheets of material hermetically sealed at the top;

c. said polyurethane material retains an amount of a pressurized inert type of gas, d. said gas being either Argon (Ar) or Krypton (Kr), and;

e. said pressurization within the said polyurethane material at between 5 psi and about 25 psi.

3. An article of footwear having substantially improved shock absorbing, energy storing and energy return characteristics, comprising;

a. an upper;

b. a resilient mid-sole attached to the upper, with an out-sole attached to the mid-sole, c. said mid-sole comprising an upper heel portion and a lower heel portion which encompass a visibly inserted, substantially heel shaped outer spring mechanism molded of a strong resiliently flexible material, d. said spring mechanism having internally formed projections which retain a quantity of vertically affixed steel compression springs in a circular pattern, e. the said outer spring mechanism further being encapsulated within a highly durable transparent polyurethane material providing relatively low air permeability characteristics and being about 1/32 of an inch in thickness, f. said polyurethane material contains an amount of pressurized gas, and;

g. said pressurization within said polyurethane material at between 5 psi and about 25 psi.

* * * * *